US006659741B2

(12) United States Patent
Spears

(10) Patent No.: US 6,659,741 B2
(45) Date of Patent: Dec. 9, 2003

(54) TRAVELLING VALVE ASSEMBLY FOR A FLUID PUMP

(76) Inventor: Jeffrey D. Spears, 22411 Moss Willow, Tomball, TX (US) 77375

( * ) Notice: Subject to any disclaimer, the term of this patent is extended or adjusted under 35 U.S.C. 154(b) by 0 days.

(21) Appl. No.: 09/967,580

(22) Filed: Sep. 28, 2001

(65) Prior Publication Data

US 2002/0076343 A1 Jun. 20, 2002

Related U.S. Application Data

(60) Provisional application No. 60/236,482, filed on Sep. 29, 2000.

(51) Int. Cl.[7] ..... F04B 39/10
(52) U.S. Cl. ..... 417/555.2; 417/556
(58) Field of Search ..... 417/555.2, 556, 417/552, 520, 554, 456, 444, 445, 435

(56) References Cited

U.S. PATENT DOCUMENTS 4,599,054 A 7/1986 Spears
4,907,953 A * 3/1990 Hebert et al. ..... 417/444
5,382,142 A 1/1995 Spears
5,431,229 A * 7/1995 Christensen ..... 166/369
5,593,289 A * 1/1997 Tarpley ..... 417/454
5,593,292 A * 1/1997 Ivey ..... 417/554
6,007,314 A * 12/1999 Nelson, II ..... 417/456
6,220,358 B1 * 4/2001 Leniek, Sr. ..... 166/369
6,257,850 B1 * 7/2001 Conn ..... 417/547

* cited by examiner

*Primary Examiner*—Teresa Walberg
*Assistant Examiner*—Vinod D. Patel
(74) *Attorney, Agent, or Firm*—Bracewell & Patterson, LLP

(57) ABSTRACT

A travelling valve assembly for use in a sucker rod activated fluid pump includes: a flow through body member having at least one rounded groove formed in the lower end of a central passageway of the flow through body member; and a downwardly depending member adapted to strike a ball valve of the valve assembly after the ball valve rises off a valve seat member of the valve assembly.

10 Claims, 3 Drawing Sheets

FIG.4
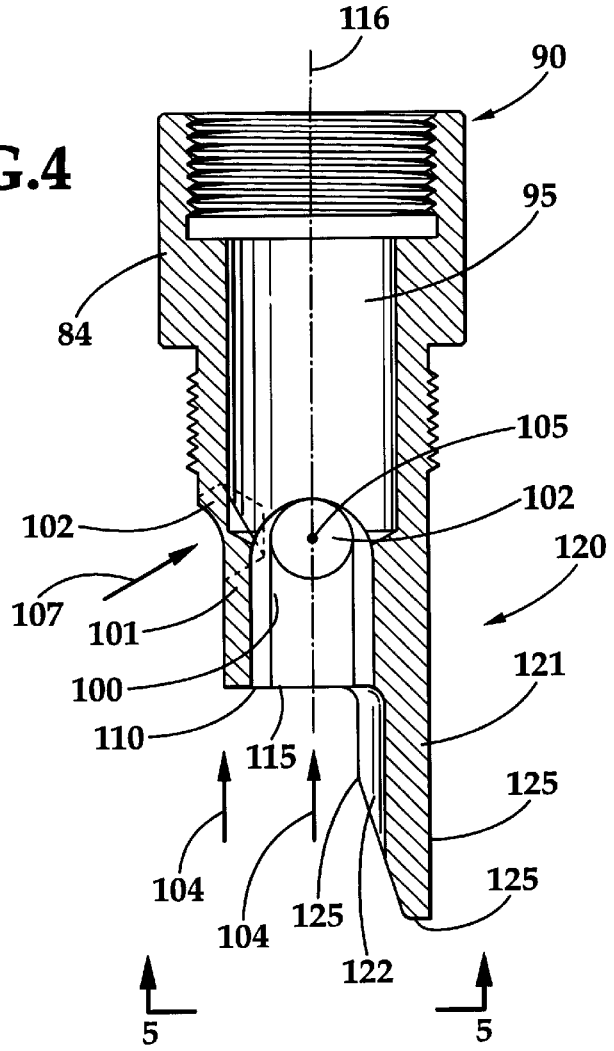
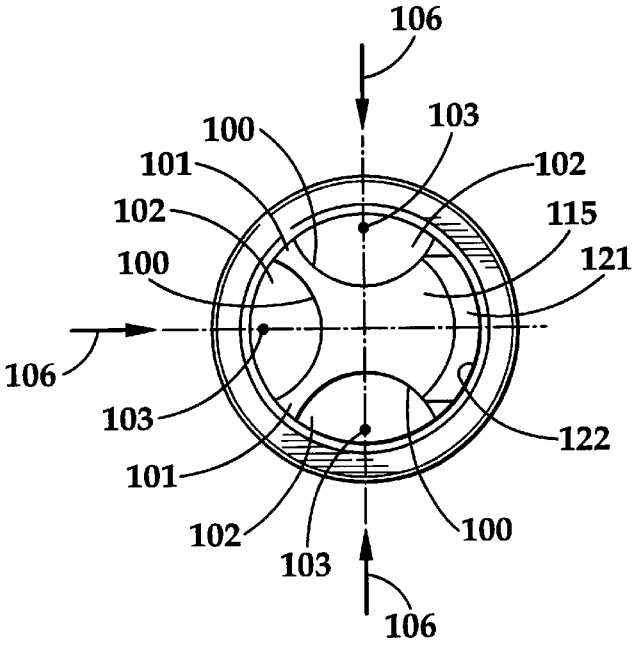
FIG.5

TRAVELLING VALVE ASSEMBLY FOR A FLUID PUMP

RELATED APPLICATION

This application claims the benefit of U.S. Provisional Patent Application Ser. No. 60/236,482 filed Sep. 29, 2000 entitled Travelling Valve Assembly for a Fluid Pump.

BACKGROUND OF THE INVENTION

1. Field of the Invention

The invention relates to a travelling valve assembly for a fluid pump for elevating fluids, and in particular, to a travelling valve assembly for a fluid pump for raising petroleum fluids through production tubing in completed oil wells.

2. Description of Related Art

A conventional oil well includes a cased well bore with one or more strings of tubing extending downwardly through the casing into the oil or other petroleum fluid contained in the sub-surface mineral formation to be produced. The casing is perforated at the level of the production zone to permit fluid flow from the formation into the casing, and the lower end of the tubing string is generally open to provide entry for the fluid into the tubing.

One type of pump conventionally employed in structures of the type described is wedged into an internal constriction or seating nipple formed internally of the tubing below the fluid level. A metallic enlargement on the external body of the pump prevents it from travelling below the seating nipple and resilient seal rings on the body of the pump housing, or pump barrel, act to form a leak proof seal between the seating nipple and pump housing, or barrel. The pump is generally driven by a mechanical linkage of metal rods, generally referred to as sucker rods, or valve rods, which extend from the pump to the well surface. The valve rod, or sucker rod, linkage is powered in a reciprocating motion by a conventional mechanical apparatus, usually called a pumping unit located at the well surface.

The conventional pump itself generally includes a housing through which a piston is reciprocated by the sucker rod, or valve road, linkage. In its simplest form, the conventional pump of the type described often includes a number of ball and seat valves with one such valve in, above, or below, the piston, or a travelling valve assembly, and another at the inlet port of the housing or barrel. On the upstroke of the plunger, the ball in the inlet port valve is drawn away from its seat and the ball of the outlet port valve is forced over its seat to draw fluid from below the seating nipple and into the housing. On the piston's downstroke, the ball in the inlet valve is forced onto its seat and the ball in the piston valve, or travelling valve, moves away from its seat to allow the piston to move downwardly through the fluid contained in the housing. On the subsequent upstroke, the closing of the piston valve forces the fluid above the piston out of the housing through the outlet ports and into the tubing above the sealing nipple and simultaneously fills the housing below the piston with fluid. Repetition of this cycle eventually fills the tubing string and causes the fluid to flow to the surface.

The previously described pump or some variation thereof is probably the most widely employed in applications where it is desired to drive a sub-surface pump by a surface powered, mechanical linkage. A significant problem in pumps of this type is that the ball of the travelling valve assembly, during the downstroke typically rotates within its housing, or cage, in the same general path, and the ball wears out the cage, whereby the pump must be pulled from the well, so that the cage may be replaced.

Accordingly, prior to the development of the present invention, there has been no travelling valve assembly for a sucker rod actuated fluid pump for raising petroleum fluids through production tubing in completed oil wells which prevents excessive wear to the cage, or housing, of the travelling valve assembly, which can lead to failure of the pump. Therefore, the art has sought a travelling valve assembly for a sucker rod actuated fluid pump for raising petroleum fluids through production tubing in completed oil wells which reduces excessive wear to the cage, or housing, of the travelling valve assembly, thus increasing the time within which the fluid pump may be used before pulling the pump to replace travelling valve assembly components, such as the cage, or housing.

SUMMARY OF THE INVENTION

In accordance with the present invention, the foregoing advantages have been achieved through the present travelling valve assembly, for use in a sucker rod actuated fluid pump which has a pump barrel and a moveable piston, or plunger, disposed within the pump barrel.

The travelling valve assembly of the present invention, when compared with previously proposed prior art travelling valve assemblies for fluid pumps, has the advantage of preventing excessive wear to the cage, or housing, of the travelling valve assembly; and additionally is believed to provide: the pumping of more fluid per pump stroke; reduced operating costs for the well; and increased fluid production.

BRIEF DESCRIPTION OF THE DRAWING

In the drawing:

FIG. 4 is a partial cross-sectional view of a portion of the travelling valve assembly of FIGS. 1–3; and FIG. 5 is an end view taken along line 5—5 of FIG. 4.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
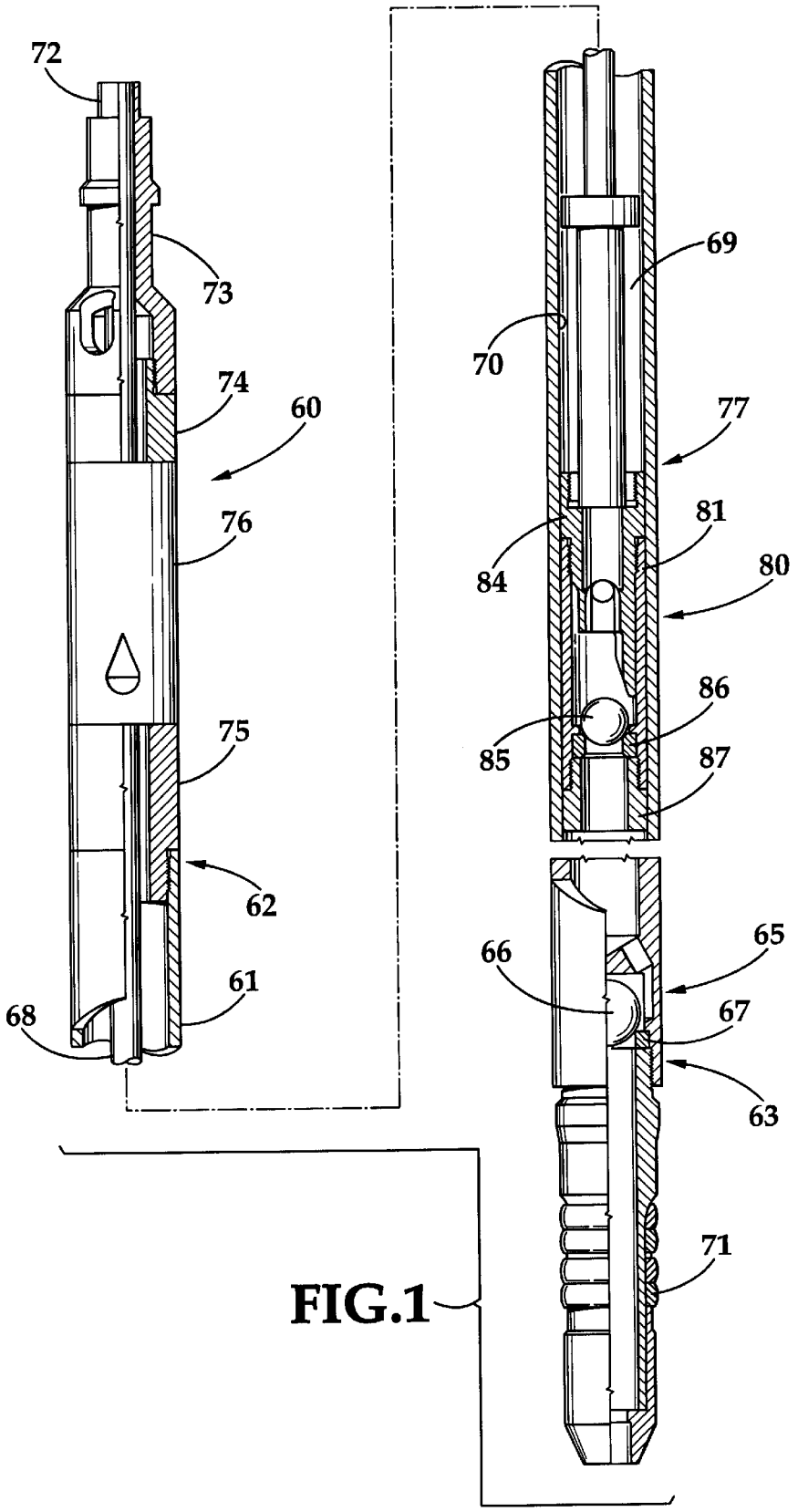
FIG. 1 is a partial cross-sectional view along the longitudinal axis of a fluid pump and travelling valve assembly in accordance with the present invention.

In FIG. 1, a fluid pump 60 for elevating fluids, in particular a fluid pump 60 for raising petroleum fluids (not shown) through production tubing (not shown) in a completed oil well is shown to include a conventional pump barrel, or housing, 61, having upper and lower ends 62, 63, with a conventional standing valve 65 disposed at the lower end 63 of pump barrel 61. Standing valve 65 is typically a conventional ball check valve and seat 66,67. Fluid pump 60 includes at least one conventional sucker rod, or valve rod, 68 and a moveable piston, or plunger, 69 is disposed within the pump barrel 61 in a sliding, sealing relationship with the interior surface 70 of barrel 61. As is known in the art, fluid pump 60 may also include a conventional hold down assembly 71 at the lower end 63 of the pump barrel 61; and a valve rod bushing 72, valve rod guide 73, connector member 74, and barrel connector member 75 disposed above pump barrel 61. If desired, a conventional, optional top valve housing 76 may be interposed between connector member 74 and barrel connector member 75.

Figure 2:
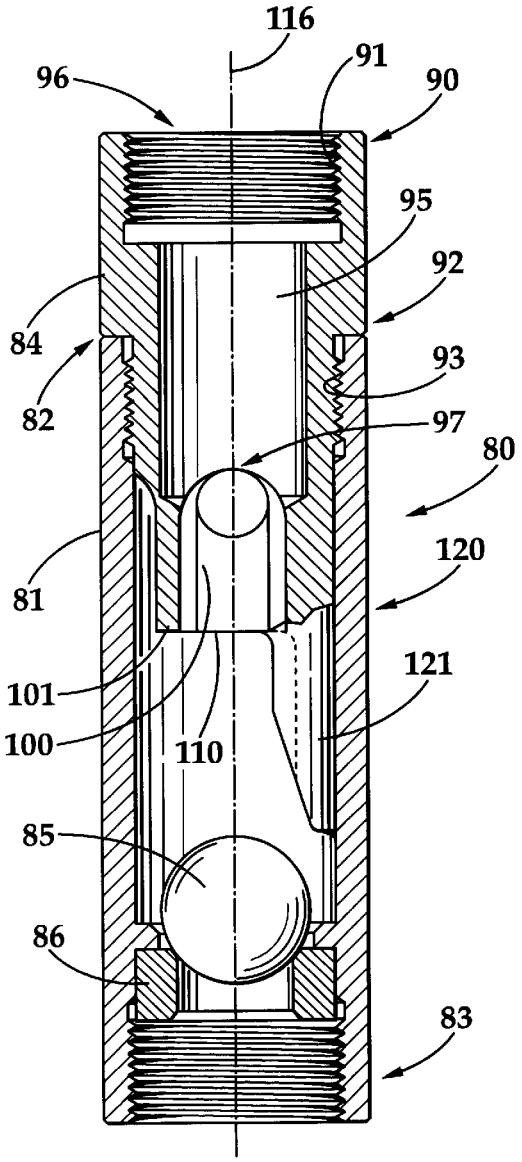
FIG. 2 is a partial cross-sectional view along the longitudinal axis of the travelling valve assembly of FIG. 1.
Figure 3:
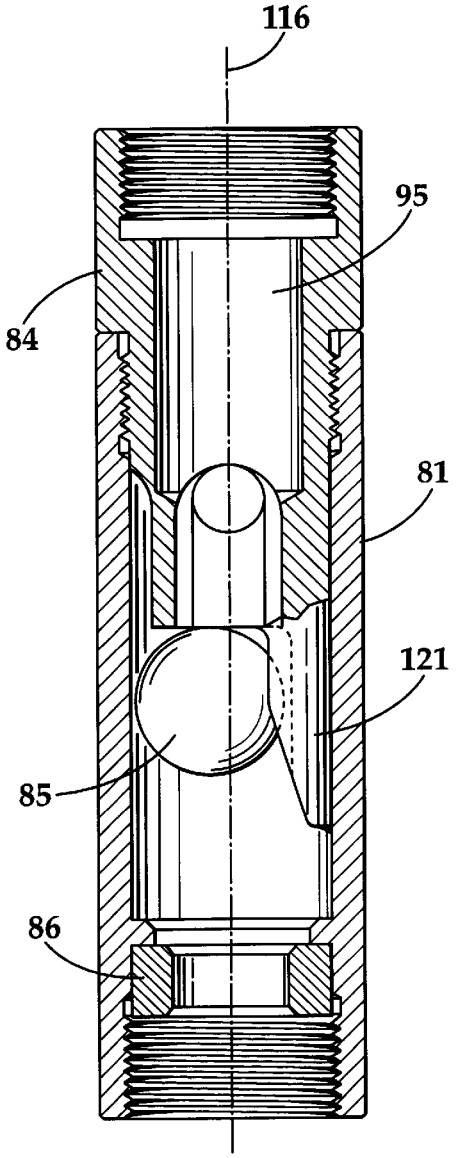
FIG. 3 is a partial cross-sectional view along the longitudinal axis of the travelling valve assembly of FIGS. 1 and 2, with the ball illustrated in a downstroke position.

Still with reference to FIG. 1, a travelling valve assembly 80, in accordance with the present invention, is disposed at the lower end 77 of plunger 69. With reference to FIGS. 1–3, travelling valve assembly 80 is shown to generally comprise: a housing 81 having upper and lower ends 82, 83; a flow through body member 84, generally disposed within the upper end 82 of housing 81, and which is adapted to be secured to the lower end 77 of plunger 69; a ball, or ball valve, 85; a conventional seat member 86, generally disposed toward and within the lower end 83 of housing 81; and a seat plug member 87 (FIG. 1) received within the lower end 83 of housing 81, which retain valve seat 86 within housing 81. FIG. 2 illustrates the location of ball 85 in its seated position upon seat 86 during the upstroke of fluid pump 60. FIG. 3 illustrates a location of ball 85 within housing 81 of travelling valve assembly 80 during the downstroke of the fluid pump 60.

As is conventional in the art, when ball 85 is in an open, fluid transmitting position such as is illustrated in FIG. 3 with respect to the valve seat 86, the configuration of travelling valve assembly 80 corresponds to a point in time when sucker rod, or valve rod 68 is travelling through its downstroke movement. During the downstroke movement of valve rod, or sucker rod, 68, the lower standing valve 65 is closed as illustrated in FIG. 1, due to the compression of the fluid (not shown) contained in the lower end 63 of pump barrel 61 by the downward movement of piston, or plunger, 69. Because ball valve, or ball, 85 is disposed in its first open, fluid transmitting position, as shown in FIG. 3 with respect to seat, or valve seat, 86, the fluid being compressed by plunger 69 can flow upwardly past ball valve 85, out of housing 81, and through pump barrel 61 into the production tubing string (not shown).

With reference to FIG. 2, travelling valve assembly 80 is illustrated in its configuration while sucker rod, or valve rod, 68 is moving upwardly during its upstroke movement. During the upstroke of valve rod 68, ball, or ball valve 85 is shown in its second sealed, fluid non-transmitting position with respect to valve seat 86. During the upstroke of sucker rod 68, plunger 69 would also be moving upwardly and the vacuum created by such upward movement within barrel 61 causes lower standing valve 65 to open (not shown) to allow fluid to flow into the lower end 63 of barrel 61, as is conventional in the art.

With reference to FIGS. 2–5, travelling valve assembly 80 will be described in further detail. The upper end 90 of flow through body member 84 is preferably threaded, such as by internal threads 91, which permit flow through body member 84 to be threaded upon the lower end 77 of plunger 69. Alternatively, if desired, the threads 91 could be located on the exterior of the upper end 90 of flow through body member 84 which threads would be threadedly received within the lower end 77 of plunger 69. An intermediate portion 92 of flow through body member 84 may be provided with exterior threads 93 which are threadedly received within the upper end 82 of housing 81. Alternatively, if desired the flow through body member 84 could be formed integrally with housing 81. Flow through body member 84 includes a central passageway 95, having an upper end 96 and a lower end 97. At the lower end 97 of central passageway 95, flow through body member 84 is preferably provided with at least one, and preferably three, flutes, or rounded grooves, 100 which have downwardly disposed spider members 101 disposed between adjacent flutes 100. The flutes 100 are in fluid communication with central passageway 95, and permit the flow of fluids therethrough with the fluid being capable of passing from the lower end 83 of housing 81 through flutes 100 into central passageway 95, and then out of the upper end 90 of flow through body member 84.

In the preferred embodiment, three flutes, or rounded grooves, 100, are utilized; however, it will be readily understood that a greater, or fewer, number of flutes may be provided. The flutes 100 provide three fluid passageways 102 which are thus in fluid communication with central passageway 95 of flow through body member 84. The flutes 100 and their corresponding fluid passageways 102 may be formed, as by first drilling, grinding, or milling into flow through body member 84 along the axes 103 (FIG. 5) in the direction of arrows 104 (FIG. 4). Then another drilling, grinding, or milling operation, may be performed along axis, 105, one such axis being illustrated in FIG. 4, in a direction along arrows 106 in FIG. 5, and arrow 107 (FIG. 4). The lower ends 110 of spider members 101 form a ball impact surface 115, which preferably is a substantially flat planar surface disposed substantially perpendicular to the longitudinal axis 116 of flow through body member 84. Longitudinal axis 116 is also coincident with the longitudinal axis of housing 81. If desired ball impact surface 115 could be slightly concave, or slightly convex, with respect to the longitudinal axis 116 of flow through body member 84, provided it does not provide any sharp projections which could potentially damage ball valve 85, upon ball valve 85 impacting upon ball impact surface 115.

Still with reference to FIGS. 2–5, the lower end 120 of flow through body member 84 is preferably provided with a downwardly depending member 121, which preferably includes at least one, and preferably only one, flute, or rounded groove, 122. Preferably, the various end surfaces 125 of downwardly depending member 121 have a rounded configuration, so as to not damage ball 85, upon ball 85 contacting downwardly depending member 121, as will hereinafter described in greater detail. Preferably, as shown in FIGS. 2–5, downwardly depending member 121 and spider members 101 are all formed as an integral part of flow through body member 84.

With reference to FIGS. 2 and 3, the operation of travelling valve assembly 80 will be described. During the upstroke of fluid pump 60 with ball valve 85 in its seated, sealing relationship with seat 86, as previously described, travelling valve assembly 80 functions in a conventional manner. Upon the beginning of the downstroke of fluid pump 60, wherein ball valve 85 rises off of seat 86 into a fluid transmitting relationship, it is believed that ball 85 moves upwardly within housing 81, until it is forced into an abutting relationship with the ball impact surface 115 of flow through body member 84. It is possible that ball 85 might first also contact a portion, or surface, of downwardly depending member 121, as well. As fluid passes into housing 81 through seat 86, ball 85 will begin to rotate within housing 81 in a plane which is generally perpendicular to the longitudinal axis 116 of flow through body member 84. In conventional travelling valve assemblies, the rotation of the ball within its cage, or housing, generally takes place in the same plane disposed substantially perpendicular to the longitudinal axis of the cage, or housing, of the conventional travelling valve assembly. In contrast, with the travelling valve assembly 80 of the present invention, upon the ball 85 beginning to rotate within housing 81 in a plane generally perpendicular to the longitudinal axis 116 of flow through body member 84, ball 85 will strike downwardly depending member 121. It is believed that the ball 85 striking downwardly depending member 121 tends to slow down the movement of ball 85, as well as direct ball 85 into a different plane with respect to the longitudinal axis 116 of flow through body member 84. Upon ball 85 then rotating again until it contacts downwardly depending member 121, ball 85 is again slowed down and is believed to be again deflected into another different, and random orientation and location within housing 81, thus not subjecting housing 81 to the excessive wear, and ultimate failure, encountered by conventional housings or cages of conventional travelling valve assemblies.

It should be apparent one of ordinary skill in the art that all of the components of the foregoing described fluid pump 60 may be made of any suitable metallic material having the requisite strength and durability characteristics to function in the manner previously described. Preferably travelling valve assembly 80 is made of Nitronic 50 austenitic stainless steel, XM-19 austenitic stainless steel, or K-500 monel stainless steel.

It is to be understood that the invention is not limited to the exact details of construction, operation, exact materials, or embodiment shown and described, as obvious modifications and equivalents will be apparent to one skilled in the art. For example, the shape of the downwardly depending member could be varied from that shown in the drawing. Accordingly, the invention is therefore to be limited only by the scope of the appended claims.

I claim:

1. A travelling valve assembly, for use in a sucker rod actuated fluid pump having a pump barrel having a lower end with a standing valve disposed in the lower end of the pump barrel and a moveable plunger disposed within the pump barrel, comprising:

a housing having upper and lower ends, the housing adapted to be disposed within the pump barrel and associated with the moveable plunger;

a valve seat member generally disposed toward, and within, the lower end of the housing;

a flow through body member generally disposed within, and secured to, the upper end of the housing and is adapted to be secured to the lower end of the moveable plunger;

a ball valve disposed within the housing, generally below the flow through body member, and above the valve seat member; and the flow through body member includes a downwardly depending member adapted to strike the ball valve after the ball valve rises off the valve seat member.

2. The travelling valve assembly of claim 1, wherein the flow through body member includes a central passageway having an upper and a lower end, and the lower end of the central passageway is provided with at least one rounded groove, and the at least one groove provides a fluid passageway in fluid communication with the central passageway.

3. The travelling valve assembly of claim 2, wherein three rounded grooves are provided which provide three fluid passageways in fluid communication with the central passageway, and a downwardly disposed spider member is disposed between adjacent rounded grooves.

4. The travelling valve assembly of claim 3, wherein the spider members each have a lower end, and the lower ends of the spider members form a ball impact surface, adapted to be impacted upon by the ball valve.

5. The travelling valve assembly of claim 2, including at least one downwardly disposed spider member disposed adjacent the at least one rounded groove.

6. The travelling valve assembly of claim 5, wherein the at least one spider member has a lower end, which forms a ball impact surface, adapted to be impacted upon by the ball valve.

7. The travelling valve assembly of claim 1, wherein the downwardly depending member includes one rounded groove formed in the downwardly depending member.

8. The travelling valve assembly of claim 4, wherein the housing has a longitudinal axis; and the ball impact surface is a substantially flat planar surface disposed substantially perpendicular to the longitudinal axis of the housing.

9. The travelling valve assembly of claim 6, wherein the housing has a longitudinal axis; and the ball impact surface is a substantially flat planar surface disposed substantially perpendicular to the longitudinal axis of the housing.

10. The travelling valve assembly of claim 1, wherein the housing has a longitudinal axis; and the downwardly depending member causes the ball valve to be slowed as the ball valve rotates within the housing; and the striking of the ball valve by the downwardly depending member directs the ball valve, as it rotates withing the housing, to rotate in different planes with respect to the longitudinal axis of the housing.

* * * * *